United States Patent [19]

Takase et al.

[11] Patent Number: 5,031,434

[45] Date of Patent: Jul. 16, 1991

[54] PLUG FOR MANUFACTURING SEAMLESS STEEL PIPE

[75] Inventors: Akira Takase; Takashi Tamura; Tsuneo Oikawa; Yutaka Mihara; Tomoyuki Hirakawa; Takeshi Kuwano, all of Tokyo, Japan

[73] Assignee: NKK Corporation, Tokyo, Japan

[21] Appl. No.: 486,454

[22] Filed: Feb. 28, 1990

[30] Foreign Application Priority Data

Feb. 28, 1989 [JP] Japan ..... 1-45189

[51] Int. Cl.[5] ..... B21B 25/00

[52] U.S. Cl. ..... 72/97; 72/209

[58] Field of Search ..... 72/95, 96, 97, 209

[56] References Cited

U.S. PATENT DOCUMENTS 1,963,320 6/1934 Wright .
2,392,821 1/1946 Kreag .
4,466,265 8/1984 Wessel ..... 72/97

FOREIGN PATENT DOCUMENTS 2231924 2/1973 Fed. Rep. of Germany .
192504 8/1988 Japan ..... 72/97

OTHER PUBLICATIONS

Patent Abstracts of Japan, vol. 12, No. 466, (M-722)(3313), Dec. 7, 1988; and JPA-63-192-504.
DE-C-489,432, (Rheinisch-Westfaelische Stahl-Und Walzwerke AG), 1/1930.

*Primary Examiner*—Lowell A. Larson
*Attorney, Agent, or Firm*—Sughrue, Mion, Zinn, Macpeak & Seas

[57] ABSTRACT

A plug for manufacturing a seamless steel pipe is disclosed. The plug includes the surface layer made of molybdenum or molybdenum base alloy coming in contact with a workpiece to be drilled and the core covered with the surface layer. The surface of the core being in contact with the surface layer is formed uneven. According to the invention, the surface layer and the core are strongly joined together, and the life of the plug is elongated.

10 Claims, 2 Drawing Sheets

PLUG FOR MANUFACTURING SEAMLESS STEEL PIPE

BACKGROUND OF THE INVENTION

1. Field of the Invention

This invention relates to a plug for manufacturing a seamless steel pipe.

2. Description of the Prior Art

Various kinds of plugs are used in drilling processes rolling processes (an elongator, a plug-mill, etc.) and polishing processes of manufacturing a seamless steel pipe. Since the surface of the plugs is used under a high pressure and a high shearing force at a high temperature, abrasion, melting loss, seize or the like often occurred. As a result, the life of the plug was shortened, and the quality of the internal surface was adversely affected. Thus, some inventions were provided in order to improve the life of the plug.

Seamless steel pipes are generally made of low alloy steel or high alloy steel. The low alloy steel is usually drilled with a plug having an oxide layer on the surface thereof made of low alloy steel of 0.3% C-3% Cr-1% Ni. For example, a heat treatment for forming the oxide layer on the surface of the plug is disclosed in Japanese Patent KOKAI NO. 58-19363, and a thermal spraying process of a powder mainly composed of iron oxide for forming the oxide layer is disclosed in Japanese Patent KOKAI No. 59-13924. According to the disclosure of the above patents, the plug manufactured by the above-mentioned processes could drill 500 to 1500 times a billet made of low alloy steel containing up to 2.25 wt. % of chromium to produce hollow pieces 4 to 8 meters in length, and therfore, the life of plug was elongated.

However, when a billet was made of high alloy steel such as Cr steel containing more than 13 wt. % of chromium or austenite stainless steel, the plug was seized remarkably due to a great strength at a high temperature of high alloy steel and due to the shortage of an iron oxide supplied from the billet to the surface of the plug prevented by the chromium oxide produced on the surface of the billet. As a result, a melting loss come to be remarkable as shown in FIG. 6. The plug accordingly could be used about five times at the longest, and occasionally, the plug could be used only once.

Various inventions were recently proposed to extened the life of the plug for drilling high alloy steels. For example, a combination of thermal spraying and hot isostatic pressing (HIP) process is disclosed in Japanese Patent KOKAI No. 61-286077. This process is used for coating with $ZrO_2$ for the purpose of thermal insulation of an engine room. The plug was manufactured through the thermal spraying of a nickel thermal spraying material (Ni-Cr-Al-Y) powder to the surface of the core made of carbon steel (S45C) to a middle layer, and the thermal spraying of molybdenum powder to form a surface layer, followed by the HIP treatment. According to this reference, the effect of the middle layer is remarkable, and particularly, it relaxes the thermal stress of a junction layer accompanied with a rapid change of temperature at the surface of the core. Thermal shock is improved in comparison with the same of the plug having no middle layer.

To utilize canning HIP process is disclosed in Japanese Patent KOKAI No. 62-50009. This process is, for example, used for cladding a corrosion resistant material to an inner surface of a valve for an oil well. The plug is manufactured by coating a nickel powder to the surface of the core material made of low alloy steel (3% Cr-1% Ni steel) to form a middle layer, and then, coating molybdenum powder to form a surface layer, followed by HIP treatment. According to this reference, dense sintering of the coating layers are promoted, and at the same time, a metal coating layer having a high joining ability accompanied with a diffusion is formed on the interface between the surface layer and the core material.

Another canning HIP process is disclosed in Japanese Patent KOKAI No. 62-238011. The plug is manufactured using ceramics ($Si_3N_4$, SiC) having a great strength at a high temperature and a high joining ability to a metal coating layer. According to this reference, a further excellent plug can be obtained by that dense sintering of the coating layers are promoted, and at the same time, a metal coating layer having a high joining ability accompanied with a diffusion is formed on the interface between the surface layer and the core material.

As mentioned above, the plugs disclosed in the above Japanese Patent KOKAI No. 61-286077, No. 62-50009 and No. 62-238001 are characterized in that the core material and the surface coating material are strongly joined at the joining interface accompanied with a diffusion. However, in the case of joining iron alloy to molybdenum, even if a nickel layer is provided therebetween, it is difficult to join them because of a great difference of thermal expansion coefficient between the iron alloy and the molybdenum. Moreover, when the ceramics such as $Si_3N_4$ or SiC used have a greatly lower thermal expansion coefficient than molybdenum, a large tensile stress occurred in the molybdenum layer to be broken after the HIP treatment. As shown in the examples, even in the thermal shock test, the surface layer exfoliates on a heat shock of 15 to 30 times. In these plugs, the middle layer made of nickel alloy relaxes the thermal stress on the interface of the molybdenum coating layer and the core material. However, since the thermal stress between the coating layer and the core material is actually too great, the joining interface of the coating layer and the core material is already cracked at the time of the HIP treatment, so the coating layer exfoliates away by the heat shock test. Moreover, if crack or exfoliation occurs on the coating layer, it slides on the core material and is readily broken by a high pressure and a high shearing force at actually drilling a billet or rolling.

SUMMARY OF THE INVENTION

An object of the invention is to provide a plug for manufacturing a seamless steel pipe having a long life.

Another object of the invention is to provide a plug for manufacturing a seamless steel pipe capable of producing stably a hollow piece excellent in inner surface quality.

The present inventors have investigated in order to develop a plug for manufacturing a seamless steel pipe which achieved the above objects, and completed the present invention by making a surface of a core being in contact with a surface uneven.

Thus, the present invention provides a plug for manufacturing a seamless steel pipe comprising a surface layer made of molybdenum or molybdenum base alloy coming in contact with a workpiece to be drilled and a core made of another material, the improvement which comprises the surface being in contact with the surface layer of the core is formed uneven.

DETAILED DESCRIPTION OF THE INVENTION

Figure 1:
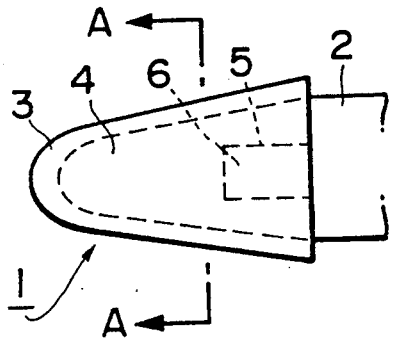
FIG. 1 is a side view indicating an embodiment of the invention applied to piercer plug.

The plug is usually formed in the shape of about a warhead, and a hole or a proJection or the like joining to a mandrel is formed on the bottom. A head part of the plug is formed in the shape of a half sphere, an umbrella or the like. The shape of the plug of the present invention is not restricted to these shapes, any known shape can be employed to the plug.

The plug is at least comprised of a surface layer coming in contact with a workpiece to be drilled and a core being in contact with the inner surface of the surface layer. The surface layer may be provided so as to cover all outer surface of the plug, or provided only at the parts where impairment is liable to occur by drilling.

The surface of the core is formed uneven being in contact with the surface layer. A shallow uneven surface such as a shot blasting surface is insufficient to be employed as the uneven surface of the core. Preferred uneven surfaces include circular, triangular or rectangular craters and grooves having a depth in some degree. Projections or convex lines may be employed instead of the above-mentioned craters and grooves, but they have a disadvantage to increase the thickness of the surface layer. A size of the unevenness, such as a diameter, a width or a depth of the unevenness depends on the size of the plug and the like, and a suitable size is about 0.005 to about 0.5 in the relative value to the diameter of the plug in order to obtain a sufficient effect, preferably about 0.05 to about 0.2 in practical use. The uneven parts of the surface layer and the core undertake the shearing force caused by a reaction force from a turning force of the workpiece. While, in the case of conventional plugs coated with molybdenum, the shearing force is undertaken mainly by the interface between the molybdenum and the core material.

The unevenness may be arranged irregularly, but is preferably arranged in parallel at equal intervals. Corners of the groove are preferably rounded to avoid stress concentration.

The core is made of a material having a thermal expansion coefficient of more than $3.8\times10^{-6}$/°C. at 20° C., and preferable materials have a thermal expansion coefficient higher than molybdenum or molybdenum base alloy, that is, a thermal expansion coefficient higher than $4.8\times10^{-6}$/°C. at 20° C. and $7.4\times10^{-6}$/°C. at 1300° C. Such a material include hot tool steels represented by SKD61, a superalloy such as Nimonic or Ninowal and ceramics having a great strength at a high temperature such as $TiB_2$ or $ZrO_2$. The core having the unevenness is formed with the machining method of cutting a billet, the casting method or the powder metallurgy method of molding and then sintering a powder. In the case that the core is made of a material having a thermal expansion coefficient of more than molybdenum and provided with rectangular grooves, owing to the cuttings in the longitudinal direction, a compressive stress generates on the interface at the side walls of the grooves between molybdenum and the core by the difference of the thermal expansion coefficients of them during cooling after HIP treatment. Thereby, both members are strongly joined by shrinkage fitting. On the other hand, in the case of conventional plugs coated with molybdenum, a great tensile stress generates on the interface between molybdenum and the core in the longitudinal direction due to the difference of the thermal expansion coefficients of them during the cooling to break the plugs.

The surface of the core is coated with molybdenum or molybdenum base alloy. Suitable molybdenum base alloy are excellent in lubricating ability and strength at a high temperature, and includes TZM(0.5 wt. % Ti-0.07 wt. % Zr-0.05 wt. % C-Bal.Mo), TZC(1.0 wt. % Ti 0.14 wt. % Zr-0.1 wt. % C-bal.Mo), ZHM(0.72 wt. % Zr-0.14 wt. % Hf 0.05 wt. % C-Bal.Mo), MHC(1.0 wt. % Hf-0.05 wt. % C-Bal.Mo) or the like.

Various coating methods are utilizable for the above coating, and include the method of joining to the core by a HIP treatment, the shrinkage fitting or the like after cutting a billet, the sintering HIP method of solidifying the powder of molybdenum or molybdenum base alloy, the canning HIP method, the explosion forming method (impact forming method) and the like.

In the case of the canning HIP treatment, first, a powder is molded by the cold isostatic pressing (CIP). Next, it is placed in a metal capsule, and sufficiently dried by vacuum heating. The capsule is sealed under vacuum and then, treated by the HIP treatment.

After joining, if need, the outer surface may be treated by a finishing work.

The plug of the present invention can be adapted not only to the above-mentioned plugs for drilling billets but also to an enlogator, a plug mill, reeler or the like.

EXAMPLES

Example 1

Figure 2:
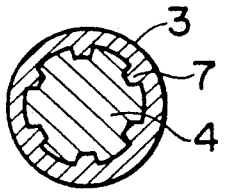
FIG. 2 shows a sectional view taken on line A—A of FIG. 1.
Figure 3:
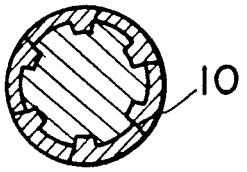
FIG. 3 is also a sectional view taken on line A—A of FIG. 1, showing cracked state after a drilling test.

The plug of Example 1 is shown in FIG. 1. The surface layer 3 of the plug was formed of molybdenum on coming in contact with a workpiece to be drilled, and a material having a thermal expansion coefficient higher than molybdenum. The surface of the core 4 was provided with grooves 7 to render uneven, as shown in FIG. 2, so that the interface between the surface layer 3 and the core 4 had a sufficient joining strength resistant to the shearing force caused by a reaction force generated by a turning force of the work at drilling. The plug 1 was formed into a shape of a warhead to be a cone body having a half spherical end.

The plug 1 was loaded at the end of a column-shaped mandrel bar 2 the bottom of which is bored to form a fitting hole 5 having a prescribed depth for attaching to the mandrel bar 2. The front end of the mandrel bar 2 was provided with a projection 6, and the plug 1 bar 2 was joined thereto by fitting the projection 6 into the hole 5.

The core 4 was made of a hot tool steel (SKD61) or a $TiB_2$ ceramic. The form of the core 4 was a warhead similar to the plug, and several grooves were formed in the axial direction.

The degree of the improvement in the plug of the invention was examined by varying the number of grooves of the core, the total area of the grooves and the shape of the grooves, compared with a plug having no groove and a plug having a middle layer made of nickel.

The core prepared had 32 mm in an outer diameter and 60 mm in length, and each plug had 32 mm in an outer diameter and 76 mm in length. The core wasprovided with six or twelve grooves having a width of 2.5 mm or 5.0 mm and a depth of 2.5 mm at equal intervals. The cores examined are summarized in Table 1.

TABLE 1

| | Material of Core | Number of Channels | Width of groove | Total Area of grooves | Coner R |
|---|---|---|---|---|---|
| No. 1 | SKD61 | 6 | 2.5 mm | 4.8 $cm^2$ | None |
| No. 2 | SKD61 | 6 | 2.5 mm | 4.8 $cm^2$ | Present |
| No. 3 | SKD61 | 6 | 5.0 mm | 9.6 $cm^2$ | Present |
| No. 4 | SKD61 | 12 | 2.5 mm | 9.6 $cm^2$ | Present |
| No. 5 | $TiB_2$ | 6 | 5.0 mm | 9.6 $cm^2$ | Present |
| No. 6 | SKD61 | Core not provided with grooves | | | |
| No. 7 | SKD61 | Shot blasting treatment (steel sphere #100) | | | |

The above seven cores were coated with molybdenum through fixing molybdenum powder to the surface of the cores by the canning HIP process, and then treated with a finishing work to complete the plug 1. The plug of No. 6 was provided with a nickel middle layer between the surface layer and the core instead of forming grooves. The surface of the core No. 7 was treated with shot blasting to make the interface between the molybdenum surface layer and the core uneven. These two plugs were compared with other five plugs.

As to the seven plugs, a model drilling test was conducted using a small drilling machine. The workpiece to be drilled was a cylindrical steel piece made of 13% Cr steel 40 mm in diameter, 200 mm in length, and formed at 1250° C. into a hollow piece having 42 mm in an outer diameter, 6 mm in thickness and 4000 mm in length. The results of the model drilling test are shown in Table 2.

TABLE 2

| | Drilling times of 13 % Cr steel (times) | Damaged state of the plug |
|---|---|---|
| No. 1 | 10 | Crack and deformation of the nose |
| No. 2 | 35 | Crack and deformation of the nose |
| No. 3 | more than 50 | Deformation of the nose |
| No. 4 | more than 50 | Deformation of the nose |
| No. 5 | more than 50 | Deformation of the nose |
| No. 6 | 1-2 | Breakage of the surface layer |
| No. 7 | 1-3 | Breakage of the surface layer |

As shown in Table 2, the plugs of the invention had a life being about five times or more than five times as many as the plugs of No. 6 and No. 7 by mere forming of grooves on the core like No. 1. When the plug of No. 1 was investigated with reference to the damaged state in detail, as shown in FIG. 2, it was found that cracks 10 occurred in the surface layer by stress concentration into the groove portions during drilling. The plugs of No. 3 and No. 4 were not cracked to endure fifty times of the drilling test with slight deformation of the end portion. The plug of No. 5 having the core made of ceramics of $TiB_2$ was not cracked and nor deformed even after carrying out fifty times of the drilling test. The end of the molybdenum surface layer was only slightly weared.

The plugs of No. 1 to No. 5 were simulated in the state of drilling a workpiece by the three demensional finite element method. When the stress generated in the grooves of No. 1 was set 100, the stress of No. 2 was about 50, and the stresses of No. 3, No. 4 and No. 5 were 30, 25 and 10. Thus, it was proved that the corner R, the numbers and the width of the grooves were effective.

EXAMPLE 2

Figure 4:
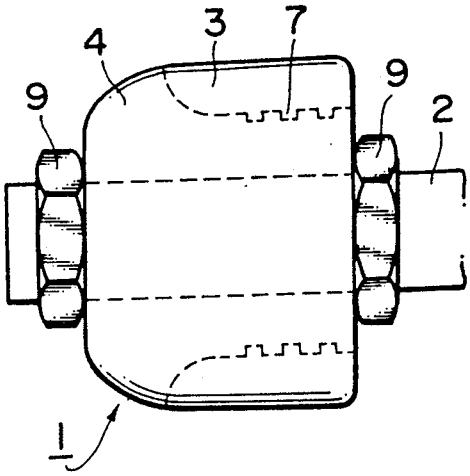
FIG. 4 is a side view of another embodiment of the invention applied to a plug mill plug.
Figure 5:
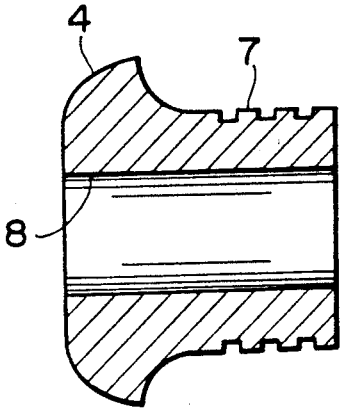
FIG. 5 is a side sectional view of the core material thereof.
Figure 6:
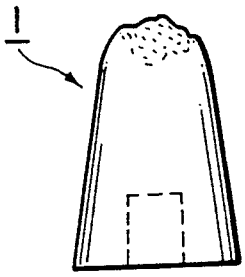
FIG. 6 is a side view of a conventional plug being in damaged state.

The plug of Example 2 is an example of the invention applied to a plug mill plug, and shown in FIGS. 4 and 5. FIG. 4 is a side view of the plug, and FIG. 5 is a side sectional view of the core.

The surface layer 3 of the plug 1 formed of molybdenum coming in contact with a workpiece to be rolled like a piercer plug, and the inner core 4 was formed of a material having a thermal expansion coefficient higher than molybdenum. The surface of the core 4 provided with grooves 7 as shown in FIG. 5 so that the joining interface between the surface layer 3 and the core 4 had a sufficient joining strength resistant to the shearing force caused by an axial force added by the workpiece during rolling. The plug 1 had a shape of about a truncated cone.

The plug 1 was attached to the front end of a columm shaped mandrel bar 2, and the center of which was bored to form a penetrated hole 8 having a prescribed diameter for attaching to the mandrel bar 2. The end of the mandrel bar 2 was threaded so that the plug 1 was fixed to the mandrel bar 2 by bolts 9.

The core 4 was made of a hot tool steel (SKD61) or $TiB_2$, and provided with several grooves 7 in a circumferencial direction.

The degree of the improvement in the plug of the invention was examined by varying the total area and the shape of the grooves, compared with a plug having no groove but having a nickel middle layer.

A peripheral portion of a core was processed so as to overlay molybdenum 20 mm in thickness to form a practical plug having 164 mm in an outer diameter and 120 mm in length. Particularly, two or three grooves having 5.0 mm or 10 mm in width and 5 mm in depth were cut at equal intervals in a circumference direction. The cores examined are shown in Table 3.

TABLE 3

| | Material of Core | Number of Grooves | Width of a Groove | Total area of Grooves | Corner R |
|---|---|---|---|---|---|
| No. 8 | SKD61 | 2 | 5 mm | 40 $cm^2$ | None |
| No. 9 | SKD61 | 2 | 5 mm | 40 $cm^2$ | Present |
| No. 10 | SKD61 | 2 | 10 mm | 80 $cm^2$ | Present |
| No. 11 | SKD61 | 3 | 5 mm | 120 $cm^2$ | Present |
| No. 12 | $TiB_2$ | 2 | 10 mm | 80 $cm^2$ | Present |
| No. 13 | SKD61 | Core not provided with grooves | | | |

The above five cores were coated with molybdenum by fixing molybdenum powder to the surface of the cores by the canning HIP process, and then treated with a finishing work to complete the plug 1. The plug of No. 13 was provided with a nickel middle layer between the surface layer and the core instead of forming grooves. The plug of No. 13 was compared with other five plugs.

These six plugs were tested by using a practical machine. A workpiece to be rolled was a hollow piece made of 13% Cr steel, and heated at 1100° C. The results of the practical machine test are shown in Table 4. In the table, the ratio of rolling times of 13% Cr steel is indicated as the ratio of the rolling times of each plug within a practical limit thereof to the rolling times of the No. 13 plug.

TABLE 4

| | Ratio of Rolling Times of 13% Cr Steel | Damaged State of Plug |
|---|---|---|
| No. 8 | 4 | Crack of molybdenum layer |
| No. 9 | 15 | Break and exfoliation of molybdenum layer |
| No. 10 | more than 30 | Wear of molybdenum layer |
| No. 11 | more than 30 | Wear of molybdenum layer |
| No. 12 | more than 30 | Wear of molybdenum layer |
| No. 13 | 1 | Break and exfoliation of molybdenum layer |

As shown in Table 4, the No. 8 plug of the invention had a life four times as many as the No. 13 plug by mere forming grooves on the core. Cracks of No. 8 occurred by stress concentration at groove parts. The cracks were remarkably improved by rounding the corner. The plugs have an endurance more than thirty times as many as the No. 13 plug by increasing the number or the total area of grooves or using a $TiB_2$ ceramic as the core.

The plugs of No. 8 to No. 12 were simulated by the three dimensional finite element method in the state of rolling the workpiece. When the stress generated in the grooves of No. 8 was set 100, the stress of No. 9 was sharply decreaed to about 65 and the stresses of No. 10, No. 11 and No. 12 were 40, 30 and 10. As a result, it was proved that the corner R, the number and the width of the grooves are effective.

We claim:

1. In a plug for manufacturing seamless steel pipe, consisting essentially of a surface layer made of molybdenum or molybdenum base alloy coming in contact with a workpiece to be drilled and a core made of another material, the improvement which comprises the surface of the core in contact with the surface layer being provided with grooves or convex lines having a depth or height of 0.05 to 0.2 as a relative value with respect to the diameter of the plug and the core being made of a hot tool steel, a super alloy or a ceramic each of which has a thermal expansion coefficient higher than $3.8\times10^{-6}$/°C. at 20° C.

2. The plug of claim 1 wherein the corners of said grooves are rounded.

3. The plug of claim 1, wherein said surface layer is shrink fit onto said core.

4. The plug of claim 1, wherein the surface of the core is provided with said grooves.

5. The plug of claim 4, wherein the corners of the grooves are rounded to avoid stress concentration.

6. The plug of claim 4, wherein said core has a thermal expansion coefficient higher than said molybdenum or molybdenum base alloy.

7. The plug of claim 1, wherein the surface of the core is provided with said convex lines.

8. The plug of claim 7, wherein said core has a thermal expansion coefficient higher than said molybdenum or molybdenum base alloy.

9. The plug of claim 1, wherein said plug has a long axis and a short axis, and wherein said grooves or convex lines extend along the long axis of the plug.

10. The plug of claim 1, wherein said plug has a long axis and a short axis, and wherein said grooves or convex lines extend along the short axis of the plug.

* * * * *